US005398053A

United States Patent [19]

Hirosawa et al.

[11] Patent Number: 5,398,053

[45] Date of Patent: Mar. 14, 1995

[54] LIQUID JET RECORDING APPARATUS HAVING AUXILIARY RECORDING HEAD

[75] Inventors: Toshiaki Hirosawa, Hiratsuka; Makoto Takamiya, Kawasaki; Haruhiko Takahashi; Hidejiro Kadowaki, both of Yokohama; Ken Tsuchii, Tokyo; Masafumi Wataya, Kawasaki, all of Japan

[73] Assignee: Canon Kabushiki Kaisha, Tokyo, Japan

[21] Appl. No.: 107,909

[22] Filed: Aug. 18, 1993

Related U.S. Application Data

[63] Continuation of Ser. No. 851,126, Mar. 16, 1992, abandoned, which is a continuation of Ser. No. 446,417, Dec. 5, 1989, abandoned.

[30] Foreign Application Priority Data

| | | | |
|---|---|---|---|
| Dec. 6, 1988 | [JP] | Japan | 63-306980 |
| Jan. 24, 1989 | [JP] | Japan | 1-13277 |
| Nov. 30, 1989 | [JP] | Japan | 1-309371 |

[51] Int. Cl.[6] ..... B41J 21/01

[52] U.S. Cl. ..... 347/13; 347/14; 347/19

[58] Field of Search ..... 346/1.1, 140; 347/5, 347/9, 12, 13, 14, 19, 57

[56] References Cited

U.S. PATENT DOCUMENTS

| | | | |
|---|---|---|---|
| 4,453,166 | 6/1984 | Enoto | 346/1.1 |
| 4,477,823 | 10/1984 | Matsufujii | 346/140 R |
| 4,500,893 | 2/1985 | Sakura | 346/76 PH |
| 4,521,805 | 6/1985 | Ayata | 358/75 |
| 4,550,327 | 10/1985 | Miyakawa | 346/140 |
| 4,580,148 | 4/1986 | Domoto | 346/140 |
| 4,590,482 | 5/1986 | Hay | 346/140 X |
| 4,593,295 | 6/1986 | Matsufujii | 346/140 |
| 4,599,627 | 7/1986 | Vollert . | |
| 4,682,216 | 7/1987 | Sasaki | 346/140 X |
| 4,721,968 | 1/1988 | Arai | 346/140 X |
| 4,723,129 | 2/1988 | Endo et al. . | |
| 4,740,796 | 4/1988 | Endo et al. . | |
| 4,774,526 | 9/1988 | Ito | 346/76 PH |

FOREIGN PATENT DOCUMENTS

| | | | |
|---|---|---|---|
| 0331481 | 9/1989 | European Pat. Off. . | |
| 60-104335 | 6/1985 | Japan . | |
| 60-104338 | 6/1985 | Japan . | |
| 228158 | 11/1985 | Japan | B41J 3/04 |
| 61-106257 | 5/1986 | Japan . | |
| 62-152887 | 7/1987 | Japan . | |

*Primary Examiner*—Joseph W. Hartary
*Attorney, Agent, or Firm*—Fitzpatrick, Cella, Harper & Scinto

[57] ABSTRACT

A liquid jet recording apparatus comprises a line type recording head emitting toward a recording medium a recording liquid for recording and a serial type recording head movable in the arrangement direction of the line type recording head orifices. The serial type recording head compensates for any improperly recording orifices of the line type recording head.

33 Claims, 8 Drawing Sheets

LIQUID JET RECORDING APPARATUS HAVING AUXILIARY RECORDING HEAD

This application is a continuation of application Ser. No. 07/851,126, filed Mar. 16, 1992, now abandoned, which is a continuation of application Ser. No. 07/446,417, filed Dec. 5, 1989, now abandoned.

BACKGROUND OF THE INVENTION

1. Field of the Invention

This invention relates to a liquid jet recording apparatus for discharging droplets of recording liquid and causing them to adhere to a recording medium such as paper to thereby accomplish recording of various kinds of information.

This invention also relates to a liquid jet recording apparatus particularly suitable for a line type recording head in which the dot slip from an orifice suffering from improper discharge can be corrected.

2. Related Background Art

In a liquid jet recording apparatus, droplets of ink (recording liquid) are discharged from discharge openings provided in a recording head and the discharged droplets are caused to adhere to a recording medium such as paper to thereby accomplish recording and therefore, there are many advantages that the rate of occurrence of noise is very small, that high-speed recording is possible and that plain paper can be used and recording paper of special characteristic is not required, and recording heads and liquid jet recording systems of various types have heretofore been proposed.

Also, liquid jet recording apparatuses in which recording liquid is discharged from a recording head to a recording medium such as paper or a plastic sheet and recording of characters, images, etc. is effected by a dot matrix suffer less from noise during the operation than the other recording apparatuses, and further has an advantage that the mechanical structure thereof is basically simple and inexpensive, and are adopted in various fields as the recording output apparatuses of computers, word processors, etc.

In such liquid jet recording apparatuses, recording is generally effected while a recording medium is conveyed intermittently or continuously in one direction.

Also, in recent years, as an improvement in recording speed gradually becomes required, there have come to be proposed many apparatuses having a line type recording head in which a number of recording liquid discharge openings corresponding to the full width of a recording medium are arranged in the form of a line.

Above all, a recording head of the type in which heat energy is caused to act on ink to thereby discharge the ink from the discharge openings has advantages such as good responsiveness to a recording signal and ease of the highly dense multiplication of discharge openings (see U.S. Pat. Nos. 4,723,129 and 4,740,796).

A typical example of the construction of the recording head of such a type which utilizes heat energy as ink discharge energy is shown in FIGS. 1A and 1B of the accompanying drawings. FIG. 1 shows a schematic cross-section of the recording head in the direction of a flow path, and FIG. 1B shows the relation between the joined positions of a base plate and a top plate. Also, FIG. 1B shows portions of the recording head in a schematic perspective view.

This recording head is of a construction in which electro-thermal converting members are arranged on a base body 18 and a top plate 12 is joined to a head base plate 18' in which a protective layer 11 is provided on heat generating resistors 15 and electrodes 10 in the electro-thermal converting members which are finally located below a flow path 13 and a liquid chamber 17, whereby the flow path 13 and the liquid chamber 17 are formed. In the case of the recording head shown, discharge openings 14 are formed by the head base plate and the top plate 12 being joined together.

The ink discharge energy in this recording head is imparted by an electro-thermal converting element having a pair of electrodes 10 and a heat generating resistor 15 located between these electrodes. That is, when an electric current is applied to the electrodes 10 to thereby cause the heat generating resistor 15 to generate heat, the ink in the flow path 13 lying near the heat generating resistor 15 is momentarily heated to create a bubble there, and a droplet of the ink is discharged from the discharge opening by a change in volume caused by the momentary expansion and contraction of the volume which in turn is caused by the creation of the bubble.

In a liquid jet recording apparatus using such a recording head (referred to also as an ink jet printer), the clogging of the discharge openings provided in the recording head and the entry of a bubble into an ink supply path communicating with the discharge openings may cause the deterioration of the liquid droplet discharging performance and accordingly improper ink discharge.

So, in the liquid jet recording apparatuses according to the prior art, suction means capable of opposing these discharge openings has been provided outside the discharge openings to thereby suck the ink out of the discharge openings, or the ink in the ink supply path has been pressurized to thereby cause the ink to flow at a certain degree of speed and discharge the ink from the discharge openings, whereby the causes of the improper ink discharge as noted above have been eliminated.

Where recovery is impossible by the recovery operation from the improper discharge described above, for example, in the case of trouble caused by the disconnection or the like of the heat generating resistors, the recording head has been manually interchanged.

However, in the liquid jet recording apparatus as described above, the recoverable improper ink discharge resulting from the dust near the discharge openings or the entry of a bubble into the ink supply path leading to the discharge openings and the unrecoverable improper ink discharge resulting from the trouble of the electrical system such as the disconnection or deterioration of the heat generating resistors or the short-circuiting or disconnection of the electrodes could not be judged or distinguished from each other. Therefore, in the prior-art apparatus, whenever improper ink discharge has occurred, it has been the practice to perform the recovery operation for recovering from the improper discharge by sucking the ink out of the discharge openings or pressurizing the interior of the ink supply path.

Accordingly, heretofore, even in the case of the unrecoverable electrical trouble such as the disconnection of the heat generating resistors as noted above, the above-described recovery operation has been executed several times to thereby waste the ink and time.

To solve such a problem, there is known from Japanese Laid-Open Patent Application No. 62-152887 a detecting device for detecting any abnormality when due to the electrical disconnection or the like of the recording head, the recording head is not driven by the driving means therefor. Again in this case, however, in a liquid jet recording apparatus shown in the schematic perspective view of FIG. 2 of the accompanying drawings, when the user judges the trouble to be an unrecoverable trouble, the user himself must remove the recording head 22 and replace it with a new recording head, and this has led to the problem that the recording apparatus becomes unusable until the replacement of the recording head.

Also, the aforedescribed line type recording head has a huge number of discharge openings and therefore, the probability with which discharge openings of improper discharge in which the discharge of recording liquid will become impossible due to the disconnection or contamination of the head in spite of the so-called recovery operation being performed while the head is repetitively used come into existence becomes higher. If discharge openings of such improper discharge come into existence, there will arise the problem that there can be obtained only recorded images of low quality having so-called dot slips.

To improve the quality of recording, the recording head in which the discharge openings of improper discharge have come into existence can be replaced with a new head, but the line type recording head, which has a huge number of discharge openings, is expensive as compared with ordinary recording heads and the cost of replacement becomes remarkably high.

SUMMARY OF THE INVENTION

It is an object of the present invention to provide, in view of the above-noted problems, a liquid jet recording apparatus in which the unrecoverable trouble of a head is detected and that head is automatically changed over to one of several auxiliary recording heads for use, whereby in the event of a trouble caused by the disconnection or the like of a heat generating resistor, the time and cumbersomeness required for interchanging the recording head can be eliminated and the waste of ink and time resulting from the unnecessary discharge recovery operation can be prevented.

It is another object of the present invention to provide a liquid ejection recording apparatus in which a heat generating resistor is disposed in the recording liquid path of the nozzle of a recording head and the heat generating resistor is heated to thereby discharge recording liquid from discharge openings communicating with the recording liquid path to accomplish recording, which apparatus carries a plurality of recording heads each provided with a nozzle, including auxiliary heads, on a carriage and is provided with current detecting means for detecting the value of an electric current flowing to the heat generating resistor in the recording head being used, disconnection detecting means for detecting the disconnection of the heat generating resistor on the basis of a current detection signal output from said current detecting means, and automatic head interchanging means for switching the supply of a driving signal to one of the other unused auxiliary recording heads, on the basis of a detection signal indicative of the disconnection of the heat generating resistor which is output from said breakage detecting means.

It is still another object of the present invention to provide a liquid jet recording apparatus having a recording head for discharging recording liquid to a recording medium to thereby accomplish recording, characterized by the provision of a line type recording head and a serial type recording head as said recording head, said serial type recording head being movable in the direction of arrangement of the discharge openings of said line type recording head, and to provide a liquid jet recording apparatus characterized by means for detecting any discharge opening of said line type recording head that is suffering from improper discharge.

A further object of the present invention is to provide a liquid jet recording apparatus comprising a line type recording head emitting toward a recording medium a recording liquid for conducting a recording, and serial type recording head movable in an arrangement direction of the line type recording head orifice.

A still further object of the present invention is to provide a liquid jet recording apparatus wherein a heating resistor is provided correspondingly to an orifice of a recording head so that heat of the resistor causes a recording liquid emission from the orifice, comprising current detection means for detecting current flowing through the heating resistor within the recording head in use, wherein a plurality of recording heads including a preliminary head are provided on a carriage, disconnection detecting means for detecting disconnection of the heating resistor on the basis of a current detection signal outputted from the current detection means; and head automatically exchanging means for switching a drive signal to one of the preliminary recording heads not in use automatically on the basis of the detection signal indicating the disconnection of the heating resistor outputted from the disconnection detecting means.

A still further object of the present invention is to provide a liquid jet recording apparatus comprising a recording head having an emission energy generator generating emission energy for emitting a liquid, a drive circuit generating drive signal supplied to said emission energy generator, at least one additional recording head provided correspondingly to the recording head, and a drive signal supplying circuit for making said additional recording head share at least a part of the area to be recorded by the recording head.

DESCRIPTION OF THE PREFERRED EMBODIMENTS

Figure 1A:
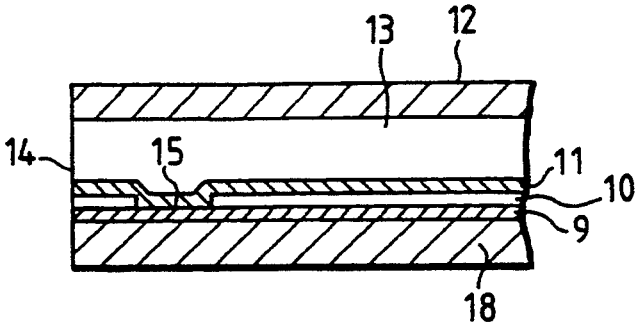
FIG. 1A PRIOR ART
FIGS. 1A and 1B schematically illustrates the construction of a recording head used in a liquid jet recording apparatus to which the present invention is applicable, FIG. 1A being a schematic fragmentary cross-sectional view, and FIG. 1B being a schematic fragmentary perspective view.

The liquid jet recording apparatus of the present invention makes-up for the improper discharge portion of a recording head (a main recording head) by another recording head (an auxiliary recording head) to thereby ensure excellent recording to be accomplished.

In that case, said another recording head prepared preliminarily may be of entirely the same construction as the main recording head, or may be of an entirely different construction if it can make up for the improper discharge of the main recording head. To make it entirely indiscernible that the improper discharge has been compnsated by said auxiliary recording head, the main recording head and the auxiliary recording head should be of the same construction and the same dimensions as far as possible. Alternatively, the auxiliary recording head should differ only in the number of discharge openings from the main recording head and should be of the same dimensions as the latter in the other portions. If it is desired to make discernable that the improper discharge has been compensated by the auxiliary recording head, to thereby endow the auxiliary recording head with the role of informing the user of the interchange of the main recording head, the auxiliary recording head may be of a construction entirely different from that of the main recording head. Accordingly, recording heads differing in supplied recording liquid (ink) prepared to effect full color recording or effect polychromatic recording may be mutually in the relation between a main recording head and an auxiliary recording head.

Also, the judgment of improper discharge may and preferably should be rendered with not only the disconnection of the recording head itself, but also the unrecoverable clogging or the like of the recording head taken into account.

Further, the recording head and the additional recording head separate from the recording head according to the present invention may be respectively full-line type and serial type ones, and vice versa. However, in case that the recording head is mainly used, it is desirable to use the full line type one as the former recording head, and the serial type one as the latter recording head. In such case, it is desirable to dispose the additional recording head so that it is movable into an area to be recorded by the recording head mainly used.

If the recording speed and the movement speed of the preliminary recording head are aligned, a single preliminary recording head can compensate for a plurality of defects of the main recording head.

A detection of improper emission portion can be performed by a disconnection detection means for detecting disconnection by means of changing of current flowing through the emission energy generator including heat a energy generator such as electric-thermo transducer having heating resistor, and also performed by means for detecting which is a visual means, or a combination of light emitting diode, solid-state laser, or incandescent lamp and solid-state photo receiving element (amorphous silicon sensor or another type of semiconductor sensor), and which detects no emission of the recording liquid based on a liquid flying used liquid adhesion on a paper. Further, another improper portion detection means detecting the improper portion based a detection of continuity between electrodes during the liquid emission may be used.

Although the present invention will hereinafter be specifically described, the present invention is not restricted to the embodiment shown below, but covers many forms conceivable within the scope of the purpose of the present invention.

According to the present invention, when nondischarge due to the disconnection of a heat generating resistor occurs in the recording head performing the recording operation, an electric current flowing through the heat generating resistor is detected to thereby detect the disconnection of the heat generating resistor and the recording head is automatically changed over to an unused auxiliary head so that the recording operation may be continued and therefore, good recording can be quickly continued and the labor of interchanging the recording head can be eliminated.

The present invention can execute recording even when discharge cannot be executed due to improper discharge.

Further, according to the present invention, even if the improper emission of a recording head of the full line type which is expensive and requires much time for interchange occurs, the improper portion is made up for by an auxiliary recording head, and this is excellent when viewed from the viewpoint of running cost.

Embodiment 1

One preferred embodiment of the present invention is described in detail with reference to the drawings as follows.

Figure 1B:
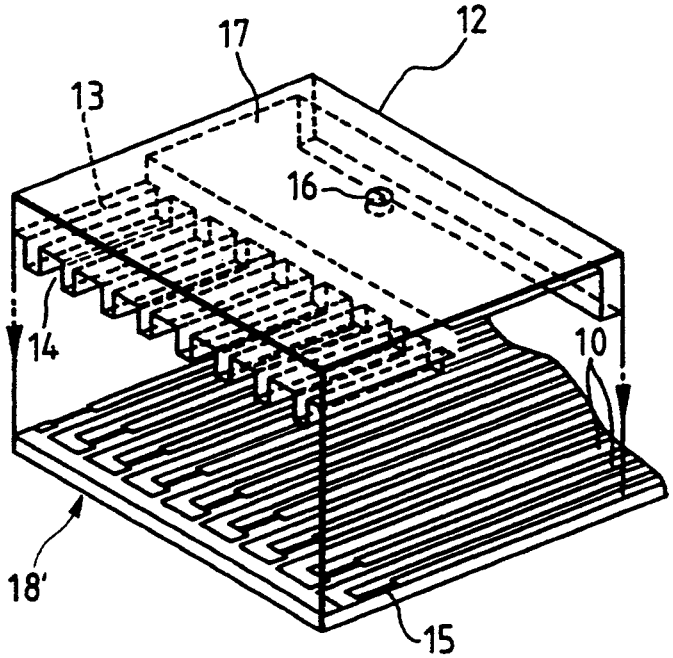
FIG. 1B PRIOR ART

As a recording head of the liquid jet recording apparatus for use in the present invention, for example, a recording head shown in FIGS. 1A, 1B may be used. Further, concretely described, in the drawings, 18 denotes a substrate of silicon (Si). 9 denotes a basic layer of silicon oxide ($SiO_2$). As a material of a heating resistor 15, $HfB_2$ is used. And it is patterned over upper surface of the basic layer 9. An electrode 10 is disposed so that it is electrically connected to the heating resistor 15. At least, a pair of them are opposed. The electrode 10 is made of a good conductor material such as aluminum.

A protective layer 11 is an insulating layer disposed over the heating resistor 15 and the opposing electrodes 10. It may be omitted if it is not necessary. 14 denotes a flow path wall made of resin or the like. Between flow path wall 14 and the substrate 18', a flow path 13 and an orifice connected to the flow path 13 are formed. An upper plate 12 is made of glass. A plastic, metal, or the like may be used in the upper plate 12.

Figure 3:
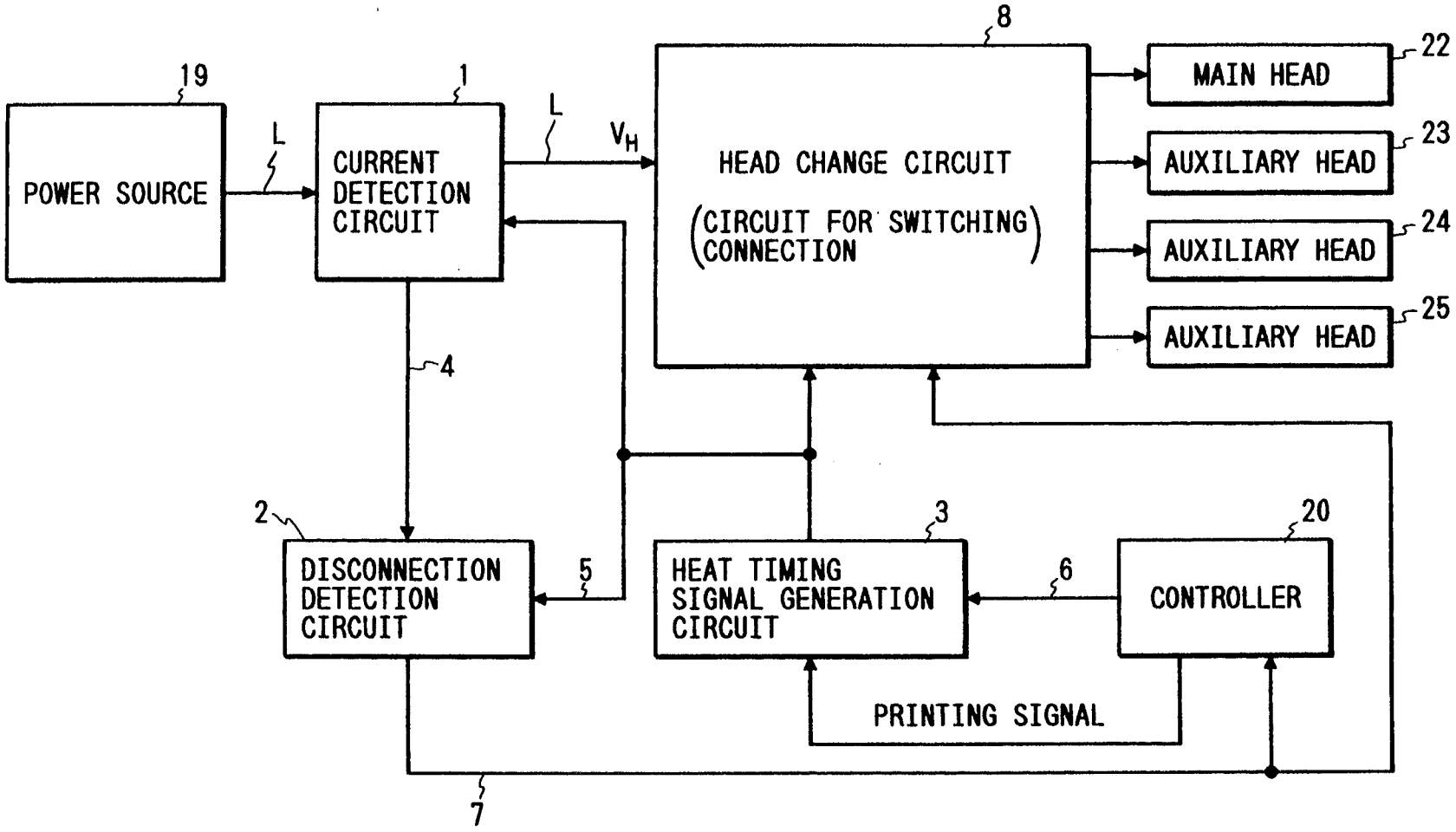
FIG. 3 is a block diagram showing the circuit construction of a circuit for detecting the disconnection of a heat generating resistor in an embodiment of the present invention and effecting the automatic interchange of a head.

FIG. 3 shows an embodiment of the construction of a circuit for detecting the disconnection of the heat generating resistor of a liquid jet recording apparatus to which the present invention is applied and automatically changing over the head used.

In FIG. 3, the reference numeral 1 designates a current detection circuit for detecting the level value of an electric current flowing through the heat generating resistors 15 (see FIG. 1) of a recording head. The reference numeral 2 denotes a disconnection detection circuit for comparing the level of a current detection signal 4 output from the current detection circuit 1 with the level of a heat timing signal 5 and outputting a head change signal 7 indicative of the fact that a heat generating resistor 15 has been disconnected.

The current detection circuit 1 is connected to an electric power supply line L which in turn is connected from a power source 19 to the heat generating resistors 15 of the recording head. During nonprinting, for example, at the home position, a disconnection check command signal 6 is applied from a controller 20 to a heat timing signal generation circuit 3, a heat timing signal 5 is sent by one pulse each from the heat timing signal generation circuit 3 to the heat generating resistors 15. The current detection circuit 1 detects the electric current flowing through each heat generating resistor 15 in conformity with the heat timing signal 5, and outputs the current detection signal 4.

Figure 4:
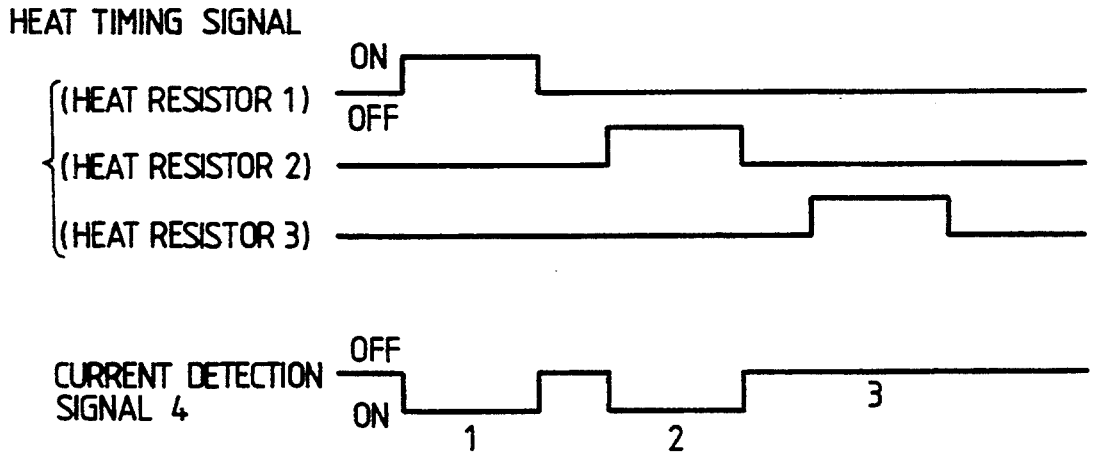
FIG. 4 is a waveform graph showing the output pulse waveforms during the disconnection of heat generating resistors in the circuit of FIG. 3.

The heat timing signal 5 and the current detection signal 4 are input to the disconnection detection circuit 2, and the disconnection of the heat generating resistors 15 is detected by the disconnection detection circuit 2, whereby the head change signal 7 is produced. When for example, the third heat generating resistor is disconnected, as shown in FIG. 4, the resistance value of the third heat generating resistor is varied by the disconnection and the third output level of the current detection signal 4 is reduced or becomes 0 and therefore, the disconnection is judged by the disconnection detection circuit 2 and the head change signal 7 is output to a head change circuit 8.

When the head change signal 7 is input to the head change circuit (a circuit for switching connection) 8, as shown in FIG. 3, electrical connection is changed over from a head (e.g. 22) in which the disconnection of a heat generating resistor has been detected to an adjacent auxiliary head (e.g. 23), and the recording operation is continued. If thereafter, the disconnection of a heat generating resistor of the recording head 23 is further detected, the change-over from the head 23 to a head 24 takes place, and it is also possible to effect the recording operation by the head 24.

Also, the controller 20 effects the adjustment of the output timing of a printing signal conforming to the position of a newly used head on a carriage correspondingly to the reception of the head change signal 7. Also, the head being used may be displaying by a lamp or the like through the controller 20 or the head change circuit 8, and when all normal heads become null, an alarm buzzer or the like may be produced.

Figure 5:
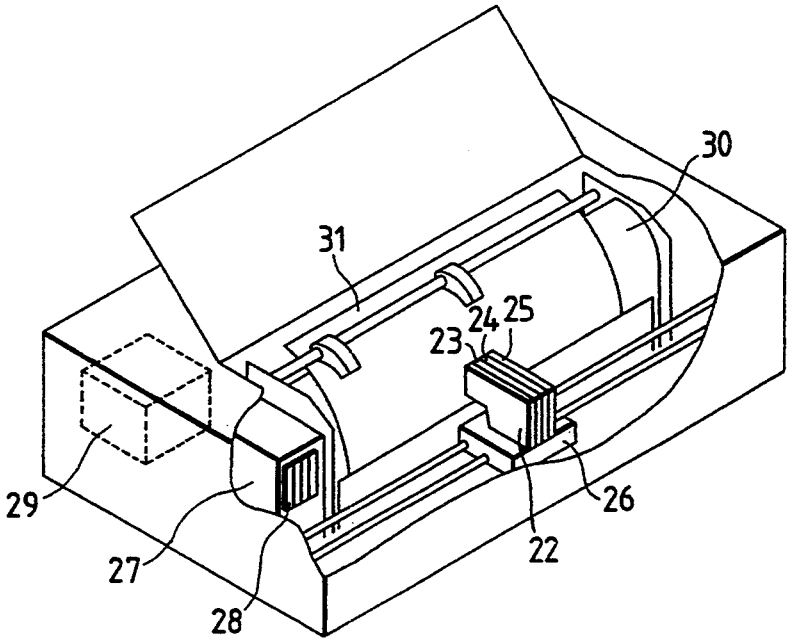
FIG. 5 is a partly broken-away perpsective view schematically showing the interior of a liquid jet recording apparatus according to an embodiment of the present invention.

In FIG. 5, the reference numeral 22 designates the main recording head, the reference numerals 23–25 denote auxiliary heads, and the reference numeral 26 designates a carriage carrying these heads 22–25 on the same surface thereof. The reference numeral 27 denotes an improper discharge recovery device, and the reference numeral 28 designates capping rubber provided on the front face of the device 27 for capping the heads 22–25. The reference numeral 29 denotes an ink supply tank, the reference numeral 30 designates a platen, and the reference numeral 31 denotes recording paper.

Figure 2:
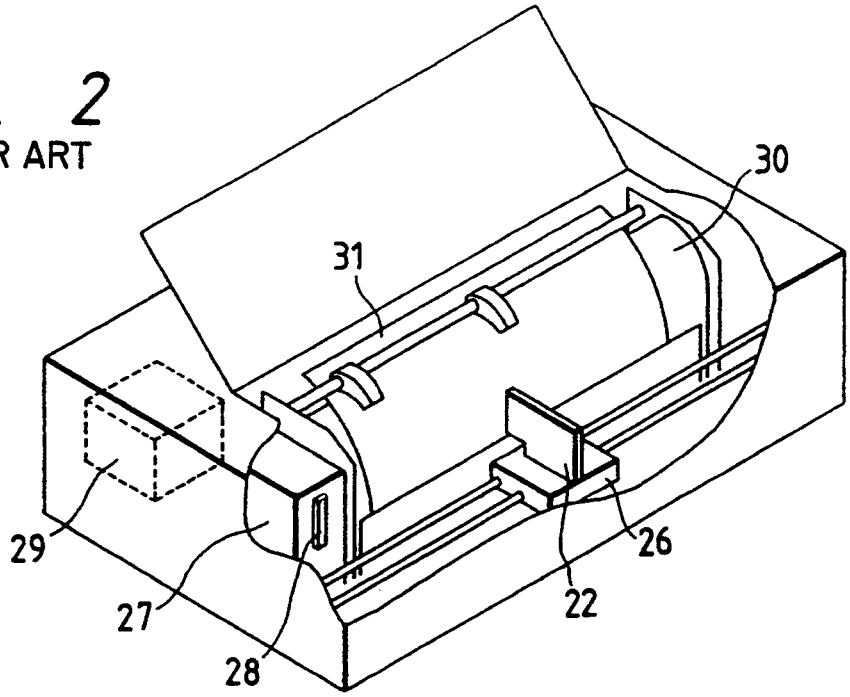
FIG. 2 PRIOR ART
FIG. 2 is a partly broken-away perspective view schematically showing the interior of a liquid jet recording apparatus according to the prior art.

FIG. 2 shows an example of the construction of the liquid jet recording apparatus according to the prior art for comparison with the embodiment of the present invention shown in FIG. 5. As shown in this figure, in the prior-art apparatus, no auxiliary recording head has been carried on a carriage 26.

Embodiment 2

Another preferred embodiment of the present invention will hereinafter be described with reference to the drawings.

Figure 6:
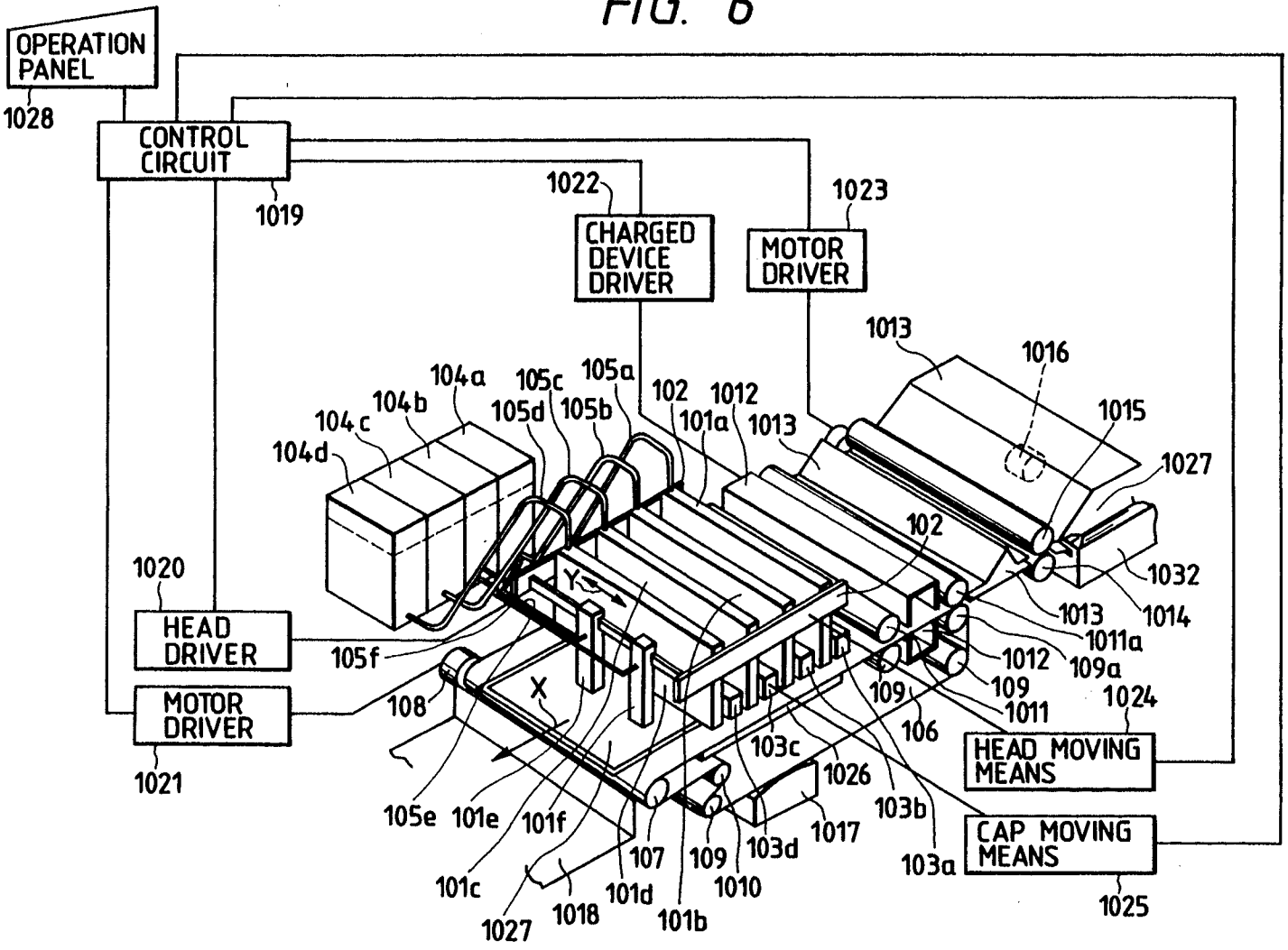
FIG. 6 shows the construction of a preferred embodiment of the present invention.

FIG. 6 shows the construction of a preferred embodiment of the present invention.

In FIG. 6, the reference characters 101*a*– 101*d* designate line type recording heads which are fixedly supported in parallelism to one another with predetermined intervals in the direction of arrow X by a holder 102. 3456 discharge openings are downwardly provided in the undersides of the recording heads 101*a*–101*d* in one line along the direction of arrow Y at an interval of 16 discharge openings/mm, whereby recording over a width of 216 mm becomes possible.

The reference characters 101*e* and 101*f* denote serial type recording heads which are reciprocally movable in the direction of arrow Y along a guide member fixed to the holder 102. A discharge opening is downwardly provided in the underside of each of the recording heads 101*e* and 101*f*.

These recording heads 101*a*–101*f* are of the type which discharges recording liquid by the utilization of heat energy, and are discharge-controlled by a head driver (a driving circuit) 1020 and controller 20 and further, the recording heads 101*e* and 101*f* are discharge-controlled in the direction of arrow Y by the head driver 1020. A head unit is constructed including the recording heads 101*a*–101*f* and the holder 102, and the head unit is vertically movable by head moving means 1024.

The reference charactrs 103*a*–103*d* designate head caps disposed correspondingly to the recording heads 101*a*–101*d*, respectively, and adjacent to the lower portions thereof. Each cap has therein an ink absorbing member formed of a porous material such as sponge.

The caps are fixedly supported by a holder, not shown, and a cap unit is constructed including said holder and the caps 103*a*–103*d*, and the cap unit is adapted to be moved by cap moving means 1025. Cyan, magenta, yellow and black inks are supplied from ink tanks 104*a*–104*d*, respectively, to the recording heads 101*a*–101*d* through ink supply tubes 105*a*–105*d* to thereby make color recording possible.

One end of each of ink supply tubes 105*e* and 105*f* is connected to the recording heads 101*e* and 101*f*, and the other ends of these tubes are connectable to any of the ink tanks 104*a*–104*d*, and in FIG. 6, the tubes 105*e* and 105*f* are connected to the ink tanks 104*a* and 104*b*, respectively.

Also, this ink supply utilizes the capillary phenomenon, and the liquid level of each ink tank is set to a level lower by a predetermined distance than the position of the discharge openings. The reference numeral 106 denotes an electrically chargeable seamless belt for conveying the recording paper 1027 which is a recording medium.

The belt 106 is passed over a predetermined path by a driving roller 107, idle rollers 109 and 109*a* and a tension roller 1010, and is moved by a belt driving motor 108 connected to the driving roller 107 and driven by a motor driver 1021.

Also, the belt 106 is moved in the direction of arrow X right beneath the discharge openings 101*a*–101*f*, and has its downward shake deflection suppressed by a fixed support member 1026. The reference numeral 1017 designates a cleaning unit for removing paper powder or the like adhering to the surface of the belt 106. The reference numeral 1012 denotes a charger for charging the belt 106. The charger 1012 is turned on and off by a charger driver 1022, and attracts the recording paper to the belt 106 with the aid of the electrostatic attraction provided by this charging.

Pinch rollers 1011 and 1011*a* which cooperate with the aforementioned idle rollers 109 and 109*a* to urge the recording paper 1027 against the belt 106 are disposed before and behind the charger 1012.

The reference numeral 1032 designates a paper supply cassette. Recording sheets 1027 in this cassette are fed out one by one by the rotation of a paper feed roller 1016 driven by a motor driver 1023, and are conveyed to a mountain-shaped guide 1013 in the direction of arrow X by a conveying roller 1014 and a pinch roller 1015 driven by the motor driver 1023.

The guide 1013 has a mountain-shaped space for permitting the flexure of the recording sheets.

The reference numeral 1018 denotes a paper discharge tray onto which the recording sheets on which recording has been effected are discharged.

The head driver 1020, the head moving means 1024, the cap moving means 1025, the motor drivers 1021 and 1023 and the charger driver 1022 are all controlled by a control circuit 1019.

The reference numeral 1028 designates an operation panel connected to the control circuit 1019.

Figure 7:
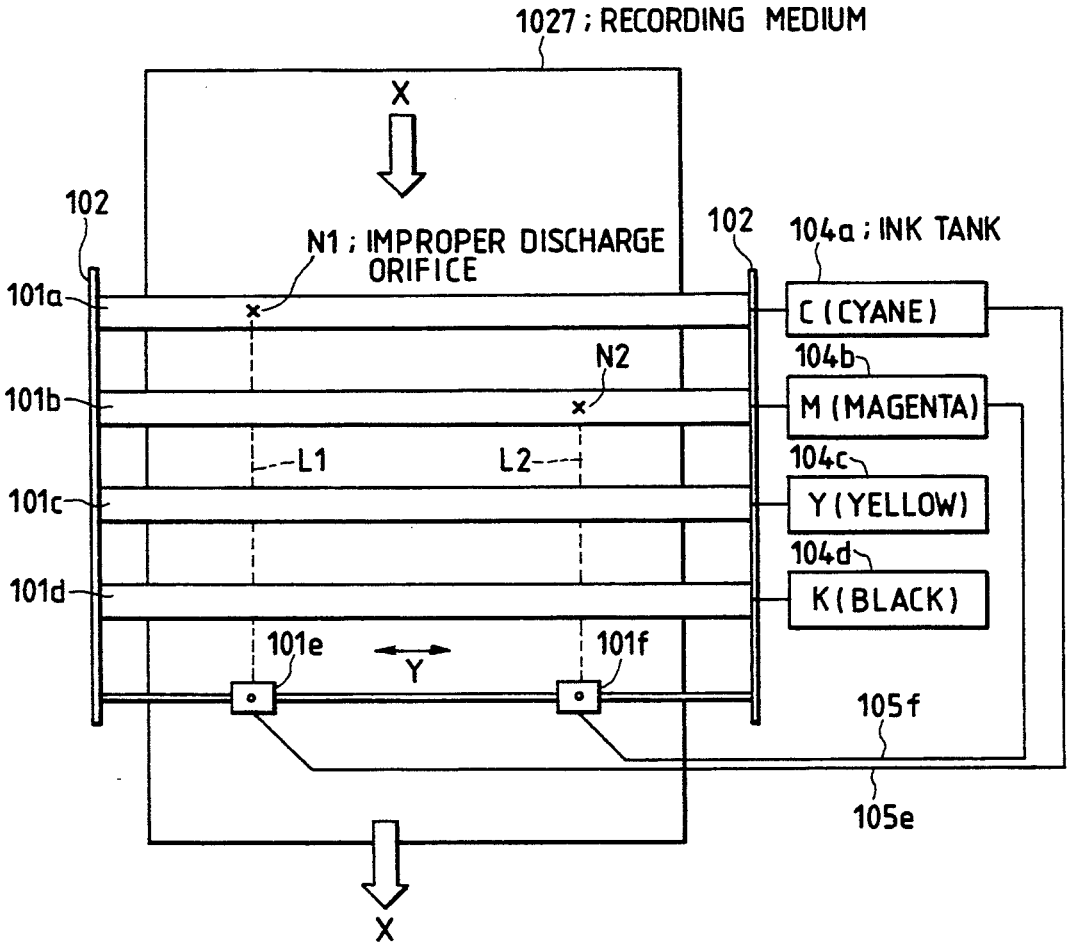
FIG. 7 illustrates the operation of correcting a dot slip in a preferred embodiment of the present

FIG. 7 illustrates the operation of correcting dot slip occurring due to the discharge openings of improper discharge of the line type recording head in the present embodiment.

FIG. 7 is a view of the head unit comprised of the line type recording heads 101*a*–101*d*, the serial type recording heads 101*e*, 101*f* and the holder 102 as it is seen from above, and shows a state in which the recording paper 1027 is attracted to the belt 106 and moved below said unit in the direction of arrow X and ink is discharged from each recording head, whereby recording is effected.

Before the apparatus of the present embodiment is used, test printing (recording) is first effected. In this test printing, a test mode is recorded on test recording paper by the use of only the line type recording heads 101*a*–101*d*, and from the then recorded image, discharge openings of improper discharge are specified.

In the present embodiment, the discharge opening N1 of the recording head 101*a* and the discharge opening N2 of the recording head 101*b* are shown as discharge openings of improper discharge.

After the discharge openings of improper discharge have been thus specified, the Nos. of the discharge openings of improper discharge are input from the operation panel 1028. Then, instead of the discharge openings N1 and N2 of improper discharge, serial type recording heads which are to effect recording are determined, and each serial type recording head and a desired ink tank are connected together by an ink supply tube.

In the present embodiment, it is to be understood that the dot slip by the discharge opening N1 of improper discharge is corrected by the recording head 101*e* and the dot slip by the discharge opening N2 of improper discharge is corrected by the recording head 101*f*, and the head 101*e* and the ink tank 104*a* are connected together by the ink supply tube 105*e*, and the head 101*f* and the ink tank 104*b* are connected together by the ink supply tube 105*f* (see FIG. 7). This connection relation is also input from the operation panel 1028.

After the test printing and data inputting as described above, printing (recording) is effected in accordance with recording information. When changeover is effected to the control of recording conforming to this information, the serial type recording heads 101*e* and 101*f* are moved to positions in the direction of arrow Y corresponding to the discharge openings N1 and N2 of improper discharge, respectively, by the head driver 1020 which has received a command from the control circuit 1019 (see FIG. 7).

Then, a recording signal to be input to the discharge opening N1 of improper discharge is input to the recording head 101*e* with a delay of the time for which the recording paper 1027 is moved over the distance between said discharge opening and the recording head 101*e*, and a recording signal to be input to the discharge opening N2 of improper discharge is input to the recording head 101*f* with a delay of the time for which the recording paper 1027 is moved over the distance between said discharge opening and the recording head 101*f*.

Accordingly, in the apparatus of the present embodiment, when as shown in FIG. 7, recording is effected in accordance with the recording signal while the recording paper 1027 is conveyed at a predetermined velocity in the direction of arrow X, a dot slip L1 of cyan in the direction of arrow X by the discharge opening N1 of improper discharge occurs between the recording head 101*a* to the recording head 101*d*, and a dot slip L2 of magenta in the direction of arrow X by the discharge opening N2 of improper discharge occurs between the recording head 101*a* to the recording head 101*d*, but corrective recording of cyan and magenta based on a regular recording signal is effected on the portions corresponding to the dot slips L1 and L2 by the recording heads 101*e* and 101*f* and therefore, good recording free of dot slips is effected on the discharged recording paper.

Figure 8:
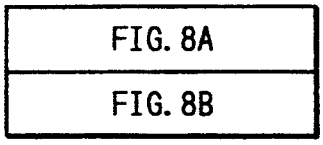
FIGS. 8, 8A and 8B are a flow chart showing the operation of a preferred embodiment of the present invention.
Figure 8A:
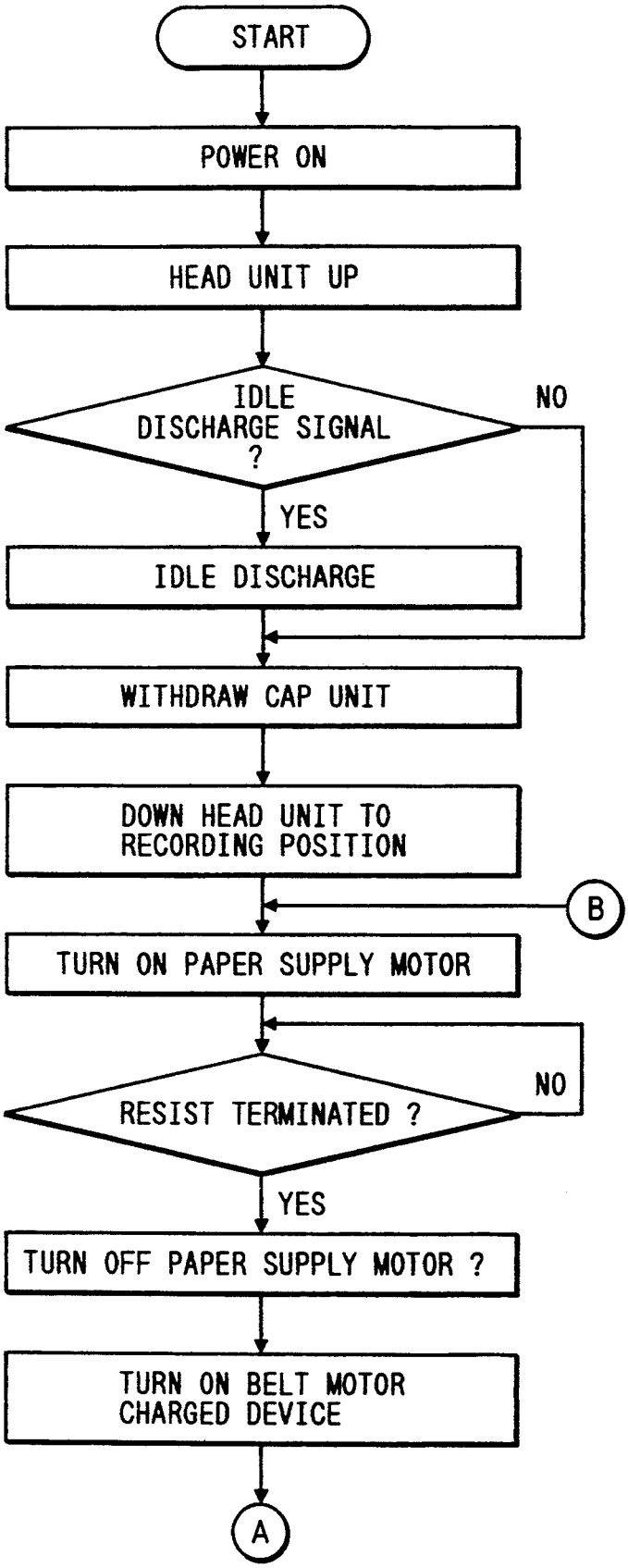
Figure 8B:
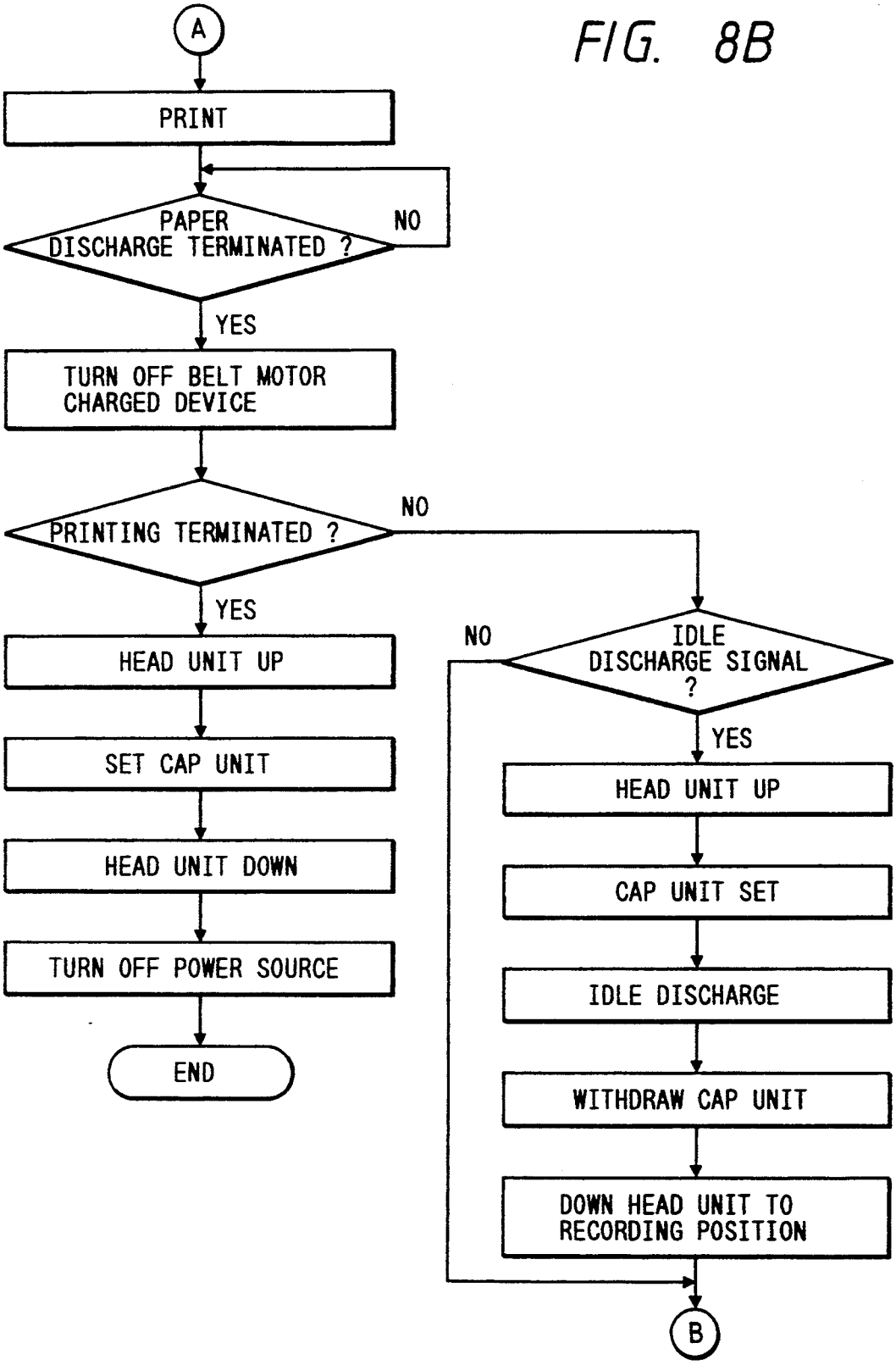

The general operation of the present embodiment will now be described with reference to the drawings. FIG. 8 is a flow chart showing this operation.

FIGS. 9A–9D are side views showing the states of the heads 101*a*–101*d* and caps 103*a*–103*d* during the operations thereof in the present embodiment.

Figure 9A:
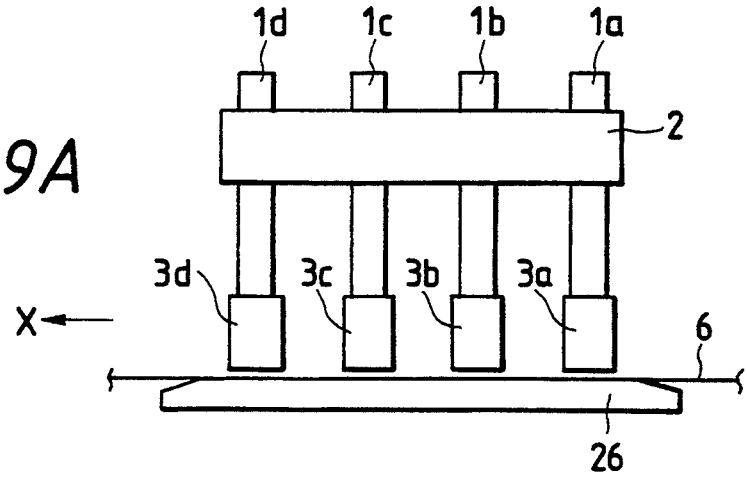
FIGS. 9A–9D show the states of heads and caps during the operations thereof in a preferred embodiment of the present invention.

FIG. 9A shows the state when the power source is OFF, and in this state, the recording heads 101*a*–101*d* are in positions wherein they have been upwardly moved from the state of FIG. 6 and the caps 103*a*–103*d* are in positions wherein they have been moved downwardly of the heads in the direction of arrow X from the state of FIG. 6. The respective heads are capped by the caps 103*a*–103*d*, whereby the evaporation of the ink from the ends of the discharge openings of the heads is prevented.

Figure 9B:
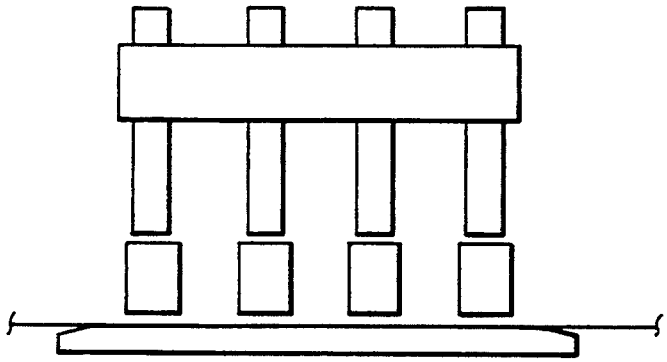

When in this state, the power source becomes ON, as shown in FIG. 9B, the head unit is raised upwardly by the order of 1 mm by the head moving means 1024. If in this state, there is an idle discharge signal, idle discharge for preventing or eliminating clogging is effected a predetermined number of times from all the discharge openings.

The discharged ink is absorbed by the ink absorbing members in the caps 103*a*–103*d*.

Figure 9C:
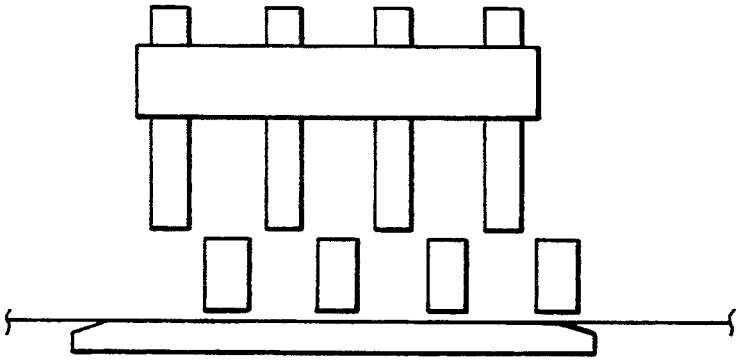
Figure 9D:
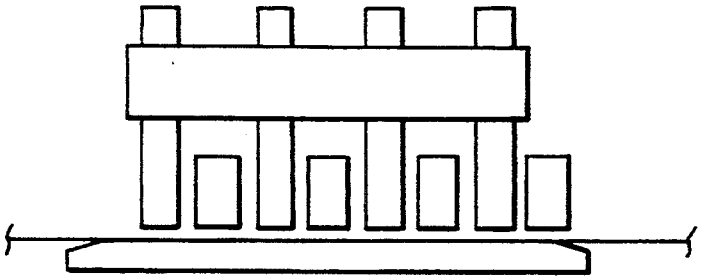

Subsequently, as shown in FIG. 9C, the cap unit is withdrawn to a predetermined position in the direction opposite to the direction of arrow X by the cap moving means 1025, and then, as shown in FIG. 9D, the head unit is moved downwardly to a predetermined position for recording (i.e., a position about 1 mm above the belt 106) by the head moving means 1024.

Subsequently, the paper feed motor is driven by the motor driver 1023 to thereby drive the paper feed roller 1016 and the conveying roller 1014, whereby a recording sheet 1027 in the paper supply cassette 1032 is fed and conveyed. The leading end edge of the recording sheet passes through the mountain-shaped guide 1013 and further arrives at the pinch roller 1011*a*, and is dashed against the portion of contact between the pinch roller 1011*a* and the belt 106 on the idle roller 109*a*, whereby the posture of the leading end edge of the recording sheet is adjusted so as to be orthogonal to the direction of arrow X. That is, the pinch roller acts as a resist portion, and during the resist, that portion of the recording sheet which has been excessively fed by the conveying roller 1014 is received into the space in the mountain-shaped guide 1013 in a flexed state.

After the leading end edge of the recording sheet has passed the mountain-shaped guide 1013 and a predetermined time has passed thereafter, the aforementioned resist operation is terminated and therefore, the paper feed motor is switched off.

Subsequently, the belt motor 108 is driven by the motor driver 1021 to start the rotation of the driving roller 107, and further the charger 1012 is turned on by the charger driver 1022. Thereby, the recording sheet 1027 after the termination of said resist is attracted to the belt 106 charged by the charger 1012 and is conveyed in the direction of arrow X.

From the point of time at which the leading end edge of the recording sheet 1027 has arrived at right beneath the heads 101*a*–101*d*, the recording liquid discharge from the heads is effected by the head driver 1020, and color printing (recording) by successive line scanning of each head is executed on the recording sheet 1027.

During this recording, the dot slip correction by the serial type recording heads 101*e* and 101*f* as described with reference to FIG. 7 is effected.

The leading end edge of the recording sheet 1027 soon arrives at the driving roller 107, where the recording sheet is discharged onto the paper discharge tray 1018 by curvature separation.

After the termination of the paper discharge, the belt motor 108 and the charger 1012 are deenergized.

Thus, recording on the recording sheet 1027 is terminated.

When recording of all the information is terminated, an operation converse to that described previously with respect to FIG. 9, i.e., bringing the head unit up→setting the cap unit (that is, positioning the caps right beneath the respective heads)→bringing the head unit down, is performed, whereafter the power source is switched off and all the operations are terminated.

On the other hand, if recording of all the information is not terminated at a point of time whereat recording on a recording sheet has been terminated, the presence or absence of an idle discharge signal is judged, and in the case of the absence of the signal, the step of energizing the paper feed motor and the subsequent steps are executed, and in the case of the presence of the signal, the steps of bringing the head unit up→setting the cap unit→executing idle discharge→withdrawing the cap unit →bringing the head unit down to the recording position are executed, whereafter the step of energizing the paper feed motor and the subsequent steps are executed, and the next recording is effected.

Other Embodiments

In Embodiment 2, the serial type recording heads 101*e* and 101*f* are mounted on the same guide member, but in the present invention, the respective serial type recording heads may be mounted on different Y-direction guide members.

Also, the number of the serial type recording heads need not be two, but may be one, or three or more. The number of the serial type recording heads can be suitably set in conformity with the expected number of discharge openings of improper discharge.

Assuming that the expected number of discharge openings of improper discharge is one per line type recording head, the same number of serial type recording heads as the line type recording heads may be prepared in advance and connected in advance to the same ink tanks as those to which the corresponding recording heads are connected.

Further, where there are two or more discharge openings of improper discharge in the same line type recording head, two or more serial type recording heads are connected to the same ink tank.

Also, in the present embodiment, discharge openings of improper discharge are specified by visual judgment using test printing, but it is also possible to provide in the apparatus itself detecting means for discharge openings of improper discharge which is similar to that in Embodiment 1, and design the apparatus such that the result of the detection automatically enters the control circuit 1019.

As such detecting means for discharge openings of improper discharge, use can be made, for example, means which detects improper discharge from the state of flow of the ink in each discharge opening, or means which detects improper discharge from the state of discharge of the ink from each discharge opening.

Also, when a discharge opening of improper discharge has been specified, it is possible to provide a mechanism and a control system for automatically connecting, on the basis of that result, a serial type head to an ink tank of a color corresponding to that discharge opening of improper discharge.

As described above, according to the present invention, when non-discharge due to the disconnection of a heat generating resistor occurs in a recording head as it is performing the recording operation, the electric current flowing through the heat generating resistor is detected to thereby detect the disconnection of the heat generating resistor and automatically change over the head to an unused auxiliary head so that the recording operation may be continued and therefore, good recording can be quickly continued and the labor of interchanging the recording head can be eliminated.

Also, according to the present invention, line type recording heads and serial type recording heads are juxtaposed and therefore, even when a discharge opening of improper discharge comes into existence in a line type recording head and the dot slip of recording by that head occurs, it can be corrected by a serial type recording head, and this leads to the possibility of recording with high quality as well as the economical effect that the interchange of the expensive line type recording head becomes unnecessary.

We claim:

1. A recording apparatus for recording on a recording medium, said apparatus comprising:

a main line type recording head for line type recording on a main recording area of the recording medium, said main recording head having a plurality of orifices spanning the width of the recording medium to record in print lines;

an auxiliary recording head, said auxiliary recording head being so positioned as to be capable of printing on a printed surface of the main recording area of the recording medium, said auxiliary recording head being distinct from said main recording head;

a moving mechanism for moving said auxiliary recording head, wherein said auxiliary recording head conducts complementary printing on a portion of the recording medium not printed due to improper printing by said main recording head within a print line of the recording medium subjected to printing by said main recording head, so as to complete the line printing by said main recording head; and a drive unit comprising;

a drive signal supplying circuit for supplying a drive signal causing said main recording head and said auxiliary recording head respectively to record on a recording medium, and control means for controlling said drive signal supplying circuit, wherein when said main recording head provides poor print quality, a drive signal is supplied to said auxiliary recording head to supplement the recording by said main recording head.

2. A recording apparatus according to claim 1, wherein the same recording liquid is supplied to both said line type main recording head and said auxiliary recording head.

3. A recording apparatus according to claim 1, wherein different recording liquids are respectively supplied to said line type main recording head and said auxiliary recording head.

4. A recording apparatus according to claim 1, further comprising a detector for detecting improperly printing orifices of said main line type recording head orifices.

5. A recording apparatus according to claim 4, wherein said auxiliary recording head is automatically brought into a position corresponding to an improperly emitting orifice of said main line type recording head by said moving mechanism on the basis of a detection result by said detector.

6. A recording apparatus according to claim 5, wherein said auxiliary recording head is an ink jet recording head using thermal energy to emit ink.

7. A recording apparatus according to claim 4, wherein said auxiliary recording head is an ink jet recording head using thermal energy to emit ink.

8. A recording apparatus according to claim 1, wherein said line type recording head and said recording head are ones for emitting the ink according to a thermal energy applied to the ink from an electro-thermal transducer provided therein.

9. A drive unit according to claim 8, wherein said recording heads are ones for emitting the ink from orifices by means of a film boiling effect in the ink according to a thermal energy generated by said electrothermal conversion element.

10. A recording apparatus according to claim 11, wherein said auxiliary recording head is an ink jet recording head using thermal energy to emit ink.

11. A drive unit for use in a recording apparatus having a main recording head for printing on a main recording area on a recording medium and at least one auxiliary recording head distinct from said main recording head, said drive unit comprising:

a drive signal supplying circuit for supplying a drive signal causing said main recording head and said auxiliary recording head respectively to record on a recording medium; and control means for controlling said drive signal supplying circuit, wherein when said main recording head provides poor print quality, a drive signal is supplied to said auxiliary recording head to supplement the recording by said main recording head, wherein said auxiliary recording head is movable to a position over the main recording area, and wherein said main head and said auxiliary recording head are separately provided.

12. A drive unit according to claim 11, wherein said main recording head and said auxiliary recording head have emission energy generating members for generating energy to emit liquid.

13. A drive unit according to claim 12, wherein said recording heads are ones for emitting the ink from orifices by means of a film boiling effect in the ink according to a thermal energy generated by said electrothermal conversion element.

14. A drive unit according to claim 11, wherein said main recording head is fixedly disposed relative to said recording apparatus.

15. A drive unit according to claim 11, further comprising a detector for detecting an improperly recording portion of said main recording head.

16. A drive unit according to claim 12, wherein the poor ink emission of the main head is detected by change in a current into the energy generation member due to a discontinuity of the energy generation member.

17. A recording method for recording on a recording medium using a main recording head having a plurality of orifices spanning a width of the recording medium to record in print lines and at least one auxiliary recording head separate from said main recording head, said method comprising the steps of:

selecting a drive signal supplying circuit for supplying a drive signal causing said main recording head and said auxiliary recording head respectively to record on a said recording medium;

selecting control means for controlling said drive signal supplying circuit, wherein when said main recording head ,provides poor print quality, a drive signal is supplied to said auxiliary recording head to supplement the recording by said main recording head;

wherein said auxiliary recording head is movable to a position over the main recording area;

detecting poor printing by said main recording head; and recording with the auxiliary recording head a portion of a recording medium not recorded due to poor recording by said main recording head according to the detection of poor printing to complete the recording to be performed by the main recording head.

18. A method according to claim 17, wherein said main recording head and auxiliary recording head are ink jet recording heads using thermal energy.

19. A process for recording on a recording medium, comprising the steps of:

selecting a main line type recording head for line type recording on a main recording area of the recording medium, said main recording head having a plurality of orifices spanning the width of the recording medium to record in print lines;

selecting an auxiliary recording head, said auxiliary recording head being so positioned as to be capable of printing on a printed surface of the main recording area of the recording medium;

selecting a moving mechanism for moving said auxiliary recording head, wherein said auxiliary recording head conducts complementary printing on a portion of the recording medium not printed due to improper printing by said main recording head within a print line of the recording medium subjected to printing by said main recording head, so as to complete the line printing by the main recording head;

and effecting recording using said recording apparatus.

20. A recording apparatus using a main recording head for printing in a recording area on a recording medium and at least one auxiliary recording head distinct from said main recording head comprising:

a drive signal supplying circuit for supplying a drive signal causing said main recording head and said auxiliary recording head respectively to record on a recording medium; and control means for controlling said drive signal supplying circuit, wherein when said main recording head provides poor print quality, a drive signal is supplied to said auxiliary recording head to supplement the recording by said main recording head; wherein said auxiliary recording head is movable to a position over the recording area.

21. A recording apparatus using the first recording head for printing on a recording area on a recording medium and at least one second recording head distinct from said first recording head comprising:

a drive signal supplying circuit for supplying a drive signal causing said first recording head and said second recording head respectively to record on a recording medium; and control means for controlling said drive signal supplying circuit, wherein when said first recording head provides poor print quality, a drive signal is supplied to said second recording head to supplement the recording by said first recording head; wherein said second recording head is relatively movable to a position over the recording area.

22. An apparatus according to claim 21, wherein said first and second recording heads are ones for emitting the ink according to a thermal energy applied to the ink from an electrothermal transducer provided therein.

23. An apparatus according to claim 22, wherein said first and second recording heads are ones for emitting the ink from orifices by means of a film boiling effect in the ink according to the thermal energy produced by said electro-thermal transducer.

24. A recording apparatus for recording on a recording medium, said apparatus comprising:

a main line type recording head for line type recording on a main recording area of the recording medium, said main recording head having a plurality of orifices spanning the width of the recording medium to record in print lines;

an auxiliary recording head, said auxiliary recording head being so positioned as to be capable of printing on a printed surface of the main recording area of the recording medium; and a moving mechanism for moving said auxiliary recording head, wherein said auxiliary recording head conducts complementary printing on a portion of the recording medium not printed due to improper printing by said main recording head within a print line of the recording medium subjected to printing by said main recording head so as to complete the line printing by the main recording head; and an original image reading means.

25. A image forming apparatus said apparatus comprising:

a main line type recording head for line type recording on a main recording area of the recording medium, said main recording head having a plurality of orifices spanning the width of the recording medium to record in print lines;

an auxiliary recording head, said auxiliary recording head being so positioned as to be capable of printing on a printed surface of the main recording area of the recording medium; and a moving mechanism for moving said auxiliary recording head, wherein said auxiliary recording head conducts complementary printing on a portion of the recording medium not printed due to improper printing by said main recording head within a print line of the recording medium subjected to printing by said main recording head so as to complete the line printing by the main recording head; and a means for transmitting and receiving an image information.

26. An apparatus according to claim 25 and further comprising an original reading means.

27. An image forming apparatus using a first recording head for printing on a recording area on a recording medium and at least one second recording head distinct from said first recording head comprising:

a drive signal supplying circuit for supplying a drive signal causing said first recording head and said second recording head respectively to record on a recording medium; and control means for controlling said drive signal supplying circuit, wherein when said first recording head provides poor print quality, a drive signal is supplied to said second recording head to supplement the recording by said first recording head; and an original reading means; wherein said second recording head is relatively movable to a position over the recording area.

28. An image forming apparatus using a first recording head for printing on a recording area on a recording medium and at least one second recording head distinct from said first recording head comprising:

a drive signal supplying circuit for supplying a drive signal causing said first recording head and said second recording head respectively to record on a recording medium; and control means for controlling said drive signal supplying circuit, wherein when said first recording head provides poor print quality, a drive signal is supplied to said second recording head to supplement the recording by said first recording head; and a transmitting means; wherein said second recording head is relatively movable to a position over the recording area.

29. An image forming apparatus according to claim 28 and further comprising an original image reading means.

30. A image processing apparatus comprising:

a main line type recording head for line type recording on a main recording area of the recording medium, said main recording head having a plurality of orifices spanning the width of the recording medium to record in print lines;

an auxiliary recording head, said auxiliary recording head being so positioned as to be capable of printing on a printed surface of the main recording area of the recording medium; and a moving mechanism for moving said auxiliary recording head, wherein said auxiliary recording head conducts complementary printing on a portion of the recording medium not printed due to improper printing by said main recording head within a print line of the recording medium subjected to printing by said main recording head so as to complete the line printing by the main recording head; and a computer.

31. An image processing apparatus comprising a recording apparatus using the first recording head for printing on a recording area on a recording medium and at least one second recording head distinct from said first recording head said recording apparatus comprising:

a drive signal supplying circuit for supplying a drive signal causing said first recording head and said second recording head respectively to record on a recording medium; and control means for controlling said drive signal supplying circuit, wherein when said first recording head provides poor print quality, a drive signal is supplied to said second recording head to supplement the recording by said first recording head; wherein said second recording head is relatively movable to a position over the recording area; wherein said information processing apparatus further comprises a computer.

32. A recording head, comprising:

a main line type recording head for line type recording on a main recording area of a recording medium, said line type recording head having a plurality of orifices spanning the width of the recording medium to record in print lines;

an auxiliary recording head, said auxiliary recording head positioned so as to be capable of printing on a printed surface of the main recording area of the recording medium, and wherein said auxiliary recording head is movable to a position over said main recording head.

33. A recording head according to claim 32, wherein said line type recording head and said auxiliary recording head emit ink according to thermal energy applied to the ink from an electro-thermal transducer.

* * * * *

UNITED STATES PATENT AND TRADEMARK OFFICE

CERTIFICATE OF CORRECTION

PATENT NO. : 5,398,053

DATED : March 14, 1995

INVENTOR(S) : TOSHIAKI HIROSAWA, ET AL.

It is certified that error appears in the above-indentified patent and that said Letters Patent is hereby corrected as shown below:

ON THE TITLE PAGE

At [75] Inventors

Insert: --Toshiyuki Yanaka, Tokyo;
Kosuke Yamamoto, Yokohama,--.

COLUMN 1

Line 61, "FIG. 1" should read --FIG. 1A--.

COLUMN 2

Line 31, "apparatuses" should read --apparatus--.

COLUMN 4

Line 28, "head automatically" should read --automatic head--.
Line 37, "drive" should read --a drive--.

COLUMN 5

Line 2, "present" should read --present invention--.
Line 13, "makes-up" should read --makes up--.
Line 23, "compnsated" should read --compensated--.
Line 30, "discernable" should read --discernible--
Line 66, "heat a" should read --heating a-- and "electric-thermo" should read --electrothermal--.

UNITED STATES PATENT AND TRADEMARK OFFICE

CERTIFICATE OF CORRECTION

PATENT NO. : 5,398,053

DATED : Mary 14, 1995

INVENTOR(S) : TOSHIAKI HIROSAWA, ET AL.

It is certified that error appears in the above-indentified patent and that said Letters Patent is hereby corrected as shown below:

COLUMN 8

Line 33, "charactrs 103a-103d" should read --characters 103a-103d--.
Line 66, "shake" should be deleted.

COLUMN 12

Line 36, "means" should read --of means--.

COLUMN 14

Line 1, "claim 11," should read --claim 1--.
Line 54, ",provides" should read --provides--.

COLUMN 15

Line 24, "appara-" should read --head.--.
Line 25, "tus." should be deleted.
Line 42, "the first" should read --a first--.
Line 66, "electro-thermal" should read --electrothermal--.

COLUMN 16

Line 20, "A" should read --An-- and "apparatus said" should read --apparatus, said--.
Line 42, "claim 25 and" should read --claim 25--.

UNITED STATES PATENT AND TRADEMARK OFFICE

CERTIFICATE OF CORRECTION

PATENT NO. : 5,398,053

DATED : March 14, 1995

INVENTOR(S) : TOSHIAKI HIROSAWA, ET AL.

It is certified that error appears in the above-indentified patent and that said Letters Patent is hereby corrected as shown below:

COLUMN 17

Line 11, "28 and" should read --28,--.
Line 13, "A" should read --An--.
Line 34, "the first" should read --a first--.

COLUMN 18

Line 2, "head" should read --head,--.
Line 15, "wherein said in-" should read
--wherein¶ said image--.
Line 16, "formation" should be deleted.
Line 34, "electro-thermal" should read --electrothermal--.

Signed and Sealed this

Eighteenth Day of July, 1995

Bruce Lehman

*Attest:*

BRUCE LEHMAN

*Attesting Officer*

*Commissioner of Patents and Trademarks*